United States Patent [19]

Tupman

[11] Patent Number: 4,825,612

[45] Date of Patent: May 2, 1989

[54] REVEAL MOLDING AND TRIM STRUCTURE

[75] Inventor: Thomas G. Tupman, Newport Beach, Calif.

[73] Assignee: Fry Reglet Corporation, Alhambra, Calif.

[21] Appl. No.: 69,873

[22] Filed: Jul. 6, 1987

[51] Int. Cl.[4] ..... E04B 2/00; E04C 2/54

[52] U.S. Cl. ..... 52/371; 52/287; 52/464; 52/718.1; 52/780

[58] Field of Search ..... 52/208, 210, 217, 241, 52/287, 288, 290, 354, 355, 461, 481, 483, 716–718, 730–733, 779, 780, 464, 371

[56] References Cited

U.S. PATENT DOCUMENTS

| | | | |
|---|---|---|---|
| 2,073,278 | 3/1937 | Hohl | 52/461 |
| 2,116,846 | 5/1938 | Pilcher | 52/312 |
| 2,339,865 | 1/1944 | Larmour | 52/464 |
| 2,803,858 | 8/1957 | Rader | 52/464 |
| 3,192,577 | 7/1965 | Barr | 52/364 |
| 3,339,324 | 9/1967 | Stackhouse | 52/464 X |
| 3,374,590 | 3/1968 | Kessler | 52/464 X |
| 3,593,475 | 7/1971 | LaGue | 52/241 |
| 3,594,972 | 7/1971 | Jones | 52/716 |
| 3,667,174 | 6/1972 | Arnett | 52/100 |
| 3,744,826 | 7/1973 | Hawes | 52/732 |
| 3,868,802 | 3/1975 | Schubach | 52/471 |
| 4,033,084 | 7/1977 | Shiflet | 52/573 |
| 4,040,223 | 8/1977 | Hillstrom | 52/483 |
| 4,706,426 | 11/1957 | Rumsey | 52/232 |

FOREIGN PATENT DOCUMENTS

| | | | |
|---|---|---|---|
| 162288 | 3/1955 | Australia | 52/717 |
| 579066 | 7/1946 | United Kingdom | 52/355 |
| 600600 | 4/1948 | United Kingdom | 52/354 |

*Primary Examiner*—John E. Murtagh
*Assistant Examiner*—Andrew Joseph Rudy
*Attorney, Agent, or Firm*—Fred Flam; Flam & Flam

[57] ABSTRACT

A molding for drywall panels or the like has a channel to provide a reveal. To provide selected finish or color, a trim structure is provided that likewise has a channel configuration. The side walls of the trim structure and the side walls of the molding provide a sawtooth and rib structure for snap connection. The ends of the trim channel sides provide laterally outwardly extending lips to overly the end edges of the molding. The trim conceals all plaster splashings, obviating cleaning, provides selected color or finish. The desirable reveal characteristic is retained by virtue of the fact that the trim structure itself is a channel.

2 Claims, 1 Drawing Sheet

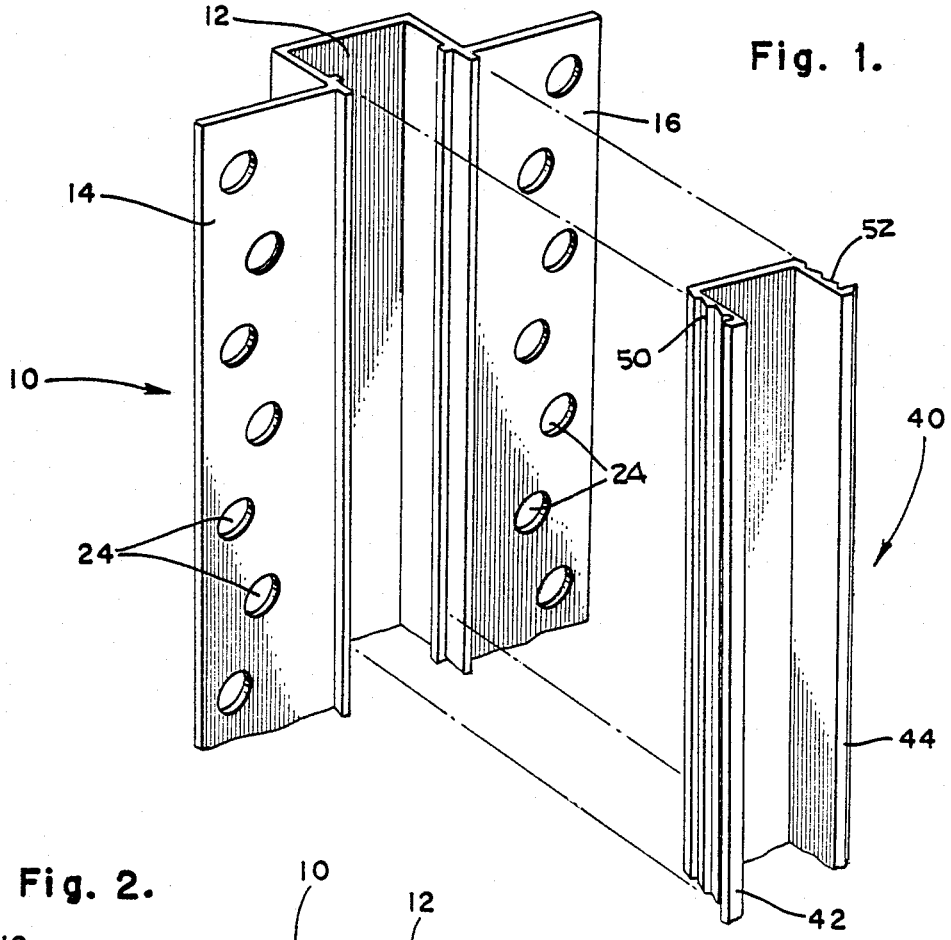
Fig. 1.
Fig. 2.
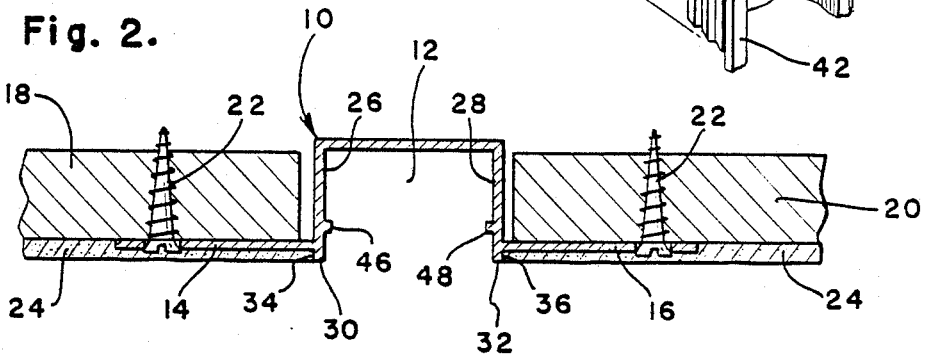
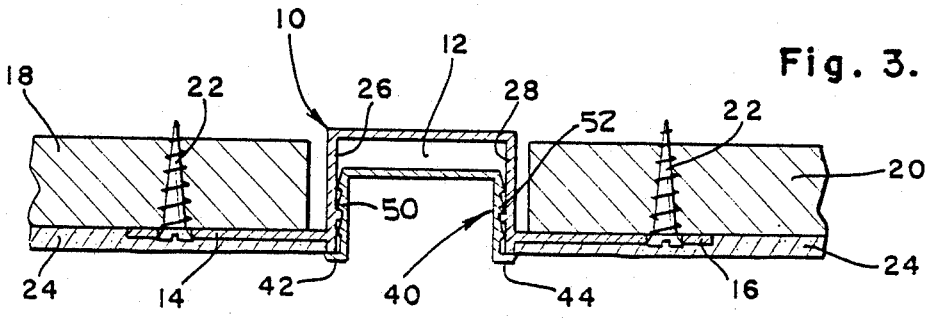
Fig. 3.

REVEAL MOLDING AND TRIM STRUCTURE

FIELD OF INVENTION

This invention relates to interior building structures, and more particularly to a snap-in trim for a reveal molding.

BACKGROUND OF THE INVENTION

Reveal moldings are quite commonly used in the construction of walls and door frames. A typical reveal molding, made, for example, of extruded metal, has flanges extending laterally outwardly from the edges of the channel sides. These flanges overly drywall panels that need not be cut to close tolerances. Single flange moldings may be used at door frames or at wall corners. After the flanges are secured to the drywall panels, tape and plaster or other compound material overlie the flanges and complete the joint. Parallelism and a neat appearance is ensured.

To keep the channel or reveal clean and free of plaster or other material, it is common for the molding supplier to fill the channels with removable foam strips. Yet the foam material is often prematurely dislodged and final cleaning of the channel may be required. Desirably that tedious cleaning step is avoided.

Architects and designers often specify different colors or finishes for the trim channels for color accents, contrasts or blends. Painting or coating the channels is a time consuming operation. Stocking a wide variety of moldings is burdensome.

Known trim structures for reveal joints do obviate the step of cleaning the reveal after compounding the joint; however, no known trim structure maintains the desirable reveal or channel appearance. Examples of such known trim structures are found in U.S.A. patents to James Larmour, U.S. Pat. No. 2,339,865 of Jan. 25, 1944; Merill E. Rader, U.S. Pat. No. 2,803,858 of Aug. 27, 1957; David W. Stackhouse, U.S. Pat. No. 3,339,324 of Sept. 5, 1967; Frank L. Shiflet, U.S. Pat. No. 4,033,084 of July 5, 1977.

It is accordingly an object of the present invention to provide a simple, easily installed, unobtrusive and effective trim structure for a reveal molding that, when installed, simply lines the interior of the channel, and provides any one of a number of selected finishes or colors.

SUMMARY OF INVENTION

In order to accomplish the foregoing objectives, I provide a trim structure made of extruded metal, such as aluminum, that itself is a simple channel sized to fit into the channel of the reveal molding. The molding and the trim are provided with companion interlock teeth that automatically engage to lock the trim structure as it is placed in position.

This invention possesses many other advantages, and has other objects which may be made more clearly apparent from a consideration of the embodiment of the invention shown and described.

BRIEF DESCRIPTION OF THE DRAWINGS

A detailed description of the invention will be made with reference to the accompanying drawings wherein like numerals designate corresponding parts in the several figures. These drawings are to scale.

FIG. 1 is an exploded perspective view of companion reveal molding and trim structure sections.

FIG. 2 is a sectional view taken transversely of a reveal molding bridging companion dry wall panels, and showing plaster or joint compound material applied.

FIG. 3 is a sectional view similar to FIG. 2 but showing the trim structure installed.

DETAILED DESCRIPTION OF PREFERRED EMBODIMENT

The following detailed description is of the best presently contemplated mode of carrying out the invention. This description is not to be taken in a limiting sense, but is made merely for purposes of illustrating the general principles of the invention, the scope of the invention being defined by the appended claim or claims.

In FIG. 1 there is shown an extruded reveal molding 10 for use at a juncture between drywall panels. The molding 10 has a channel 12 to form a reveal. Flanges 14 and 16 extend laterally outwardly to overly the edges of adjacent drywall panels 18 and 20 respectively (FIG. 2). Drywall screws 22 attach the flanges to the wall panels, passing through selected holes 24 punched in the flanges.

In order to conceal the flanges and to provide a neat joint, plaster or other like compound 24 is applied. Preferably tape (not shown) is applied over the flange edges to minimize abrupt thickness changes in the filling compound. The proximal ends of the flanges 14 and 16 join the channel sides 26 and 28 just below the channel side end edges 30 and 32 whereby convenient ground corners 34 and 36 are provided for the plaster or compound 24 to fill. The channel side end edges 30 and 32 are left exposed.

The trim structure 40, also made of extruded metal, is of channel configuration, with lips 42 and 44 projecting laterally outwardly at the ends of the channel sides. The trim structure 40 when placed in the molding channel 12 locks thereto. For this purpose, the 28 of the molding channel sides 26 and each have an inwardly projecting rib 46 and 48. These ribs 46 and 48 interfere with the inward movement of sawtooth teeth 50 and 52 formed on the sides of the trim structure channel. As the trim structure is forced inwardly, its side walls flex inwardly and the side walls of the reveal molding flex outwardly, allowing the teeth 50 and 52 to pass beyond the ribs 46 and 48. The resilience of the parts produces a snap fit. The angularity of the teeth provide outwardly facing shoulders to lock the trim structure in position.

When the trim structure 40 is installed, any stray splashing in the reveal molding is concealed. The lips 42 and 44 of the trim overlie the end edges 30 and 32 of the molding 10, and likewise conceal any splashing. A neat trim structure is thus provided that can be of any desired color or finish. This trim structure can fit reveal moldings that attach to corners or at door frames.

The trim structure 40 can be removed for replacement with other trim structure by pinching the lips 42 and 44 together until the ribs 46 and 48 are cleared.

Intending to claim all novel, useful and unobvious features and combinations of features shown and/or described, I CLAIM:

1. In an architectural reveal structure: a reveal one piece molding having a channel integrally formed by an opposing pair of side walls and a bottom wall, said reveal molding having means for its connection between a pair of wall panels defined by an integrally formed flange extending from each of said molding channel side walls for overlaying a portion of an external surface of each of said wall panels with a channel opening toward said wall panel external surface; each of said molding channel side walls having a projection extending into said channel opening for coupling a trim structure therein; each of said channel side walls having an end portion projecting substantially perpendicular from said flange wherein an intersection of said flange and said end portion of said molding channel side wall form a ground corner for a joint filling compound applied over said flange; said trim structure having a channel defined by a pair of opposing side walls and a bottom wall, said trim structure channel being sized to fit within the molding channel with the trim channel correspondingly opening toward said wall panel external surface to complete the assembly of said reveal structure; each of said trim channel side walls having a lip portion extending outwardly from said channel opening for overlaying said molding channel wall end portions subsequent to said trim channel being inserted therein; and means for securing the trim structure to the molding defined by a plurality of tooth-like projections extending from each of said trim channel side walls for releasable locking engagement with said molding channel side wall projections whereby the trim structure conceals blemishes while providing selected color and finish and is easily removed by pinching the lip portion of each of said trim channel sidewalls each toward the other.

2. In an architectural reveal structure:

a reveal one piece molding having a channel integrally formed by an opposing pair of side walls and a bottom wall, said reveal molding having means for connection to a wall panel defined by at least one integrally formed flange extending from at least one of said molding channel side walls for overlaying a portion of an external surface of said wall panel, said molding having a channel opening directed toward said wall panel external surface; each of said molding channel side walls having a projection extending into said channel opening for coupling a trim structure therein; at least one of said channel side walls having an end portion projecting substantially perpendicular from said flange wherein an intersection of said flange and said end portion of said said molding channel side wall form a ground corner for a joint filling compound applied over said flange; said trim structure having a channel defined by a pair of opposing side walls and a bottom wall, said trim structure channel being sized to fit within said molding channel with said trim channel correspondingly opening toward said wall panel external surface to complete the assembly of said reveal structure; each of said trim channel side walls having a lip portion extending outwardly from said channel opening for overlaying said molding channel wall end portions subsequent to said trim channel being inserted therein; and means for securing said trim structure to said molding defined by a plurality of tooth-like projections extending from each of said trim channel side walls for releasably locking engagement with said molding channel side wall projections whereby said trim structure conceals blemishes while providing selected color and finish and is easily removed by pinching the lip portion of each of said trim channel side walls each toward the other.

* * * * *